US005733099A

United States Patent [19]

Honneger

[11] Patent Number: 5,733,099

[45] Date of Patent: Mar. 31, 1998

[54] PROCESS AND APPARATUS FOR STACKING SHEET-LIKE PRODUCTS, IN PARTICULAR PRINTED PRODUCTS

[75] Inventor: Werner Honneger, Bäch, Switzerland

[73] Assignee: Ferag AG, Switzerland

[21] Appl. No.: 530,029

[22] Filed: Sep. 19, 1995

[30] Foreign Application Priority Data

Sep. 19, 1994 [CH] Switzerland ..... 02846/94

[51] Int. Cl.[6] ..... B65B 13/04

[52] U.S. Cl. ..... 414/788; 53/587; 271/216; 414/783; 414/786

[58] Field of Search ..... 53/587; 271/216; 414/783, 788, 798.7

[56] References Cited

U.S. PATENT DOCUMENTS

| | | | |
|---|---|---|---|
| 2,805,757 | 9/1957 | Rapley | 414/788 X |
| 3,236,162 | 2/1966 | Reist . | |
| 4,058,226 | 11/1977 | Peters, Jr. . | |
| 4,443,287 | 4/1984 | Worni | 156/247 |
| 4,531,343 | 7/1985 | Wood | 53/399 |
| 4,738,078 | 4/1988 | Benz et al. | 53/439 |
| 4,795,297 | 1/1989 | Tokuno et al. | 414/795.4 |
| 5,101,610 | 4/1992 | Honegger | 53/430 |

FOREIGN PATENT DOCUMENTS

| | | | |
|---|---|---|---|
| 0 528 772 | 2/1993 | European Pat. Off. . | |
| 29 51 154 | 7/1980 | Germany . | |
| 42 36 362 | 5/1994 | Germany . | |
| 2 088 772 | 4/1987 | Japan . | |
| 3-128857 | 5/1991 | Japan | 414/788 |

*Primary Examiner*—Janice L. Krizek
*Attorney, Agent, or Firm*—Bell Seltzer Intellectual Property Law Group of Alston & Bird LLP

[57] ABSTRACT

A specific number of printed products is arranged on a supporting belt in a compacted imbricated formation. The printed product arranged at the leading end of the imbricated formation, as seen in the conveying direction, rests with its bottom end against a stop element. The printed product arranged at the other end bears, with its lower flat side, on the supporting belt. By virtue of the upending element being pivoted from a horizontal to an upright position, the imbricated formation is formed into a horizontal stack which is transferred to the removal conveyor by means of the stack transporter.

10 Claims, 6 Drawing Sheets

PROCESS AND APPARATUS FOR STACKING SHEET-LIKE PRODUCTS, IN PARTICULAR PRINTED PRODUCTS

FIELD OF THE INVENTION

The present invention relates to a process and an apparatus for stacking sheet-like products, in particular printed products, such as newspapers, periodicals and the like.

BACKGROUND OF THE INVENTION

A prior art process and apparatus are disclosed in U.S. Pat. No. 4,531,343 to Wood. That apparatus comprises a belt conveyor wherein flexible, sheet-like products are fed in imbricated formation to a continuously driven supporting belt arranged at right angles with respect to the same. The supporting belt comprises retaining teeth which act on the rear trailing edge, as seen in the conveying direction of the supporting belt, of the fed products in order to convey these further such that they overlap one another in an imbricated manner. The bottom edges of the products, which edges are covered over by the respectively following product and are arranged towards the supporting belt, thus have a defined spacing which is maintained in the entire active region of the supporting belt. Upending plates are arranged in upright fashion on both sides of the supporting belt. These plates form a through-passage for the products, the width of which passage tapers, as seen in the conveying direction, and is smaller at the end than the width of the products measured at right angles with respect to the conveying direction. The products conveyed towards the upending plates are upended onto their bottom edge and, due to the fact that they are retained by the teeth of the supporting belt, are bent, with the result that the lateral end regions of the products are arranged behind the central region, as seen in the conveying direction. In the region of a subsequent belt conveyor, the bending of the products is further increased in order to stabilize and maintain the upright position.

In order to separate off a specific number of products from the "bundle" formed continuously in this manner, provision is made for insertion elements which are inserted between products of the "bundle" in order to convey those products which are arranged upstream of the insertion element in the conveying direction further at a greater speed and to bring them into contact with straps, which are then applied around the separated-off formation of products on three sides. As soon as the rearmost product, as seen in the conveying direction, has passed the delivery location of the straps, a restraining element is extended there, which, together with a piston/cylinder unit acting on the other end of the formation, serves to rest the products of the formation flatly against one another and to compress them to form a horizontal stack. The straps are then connected to form a closed loop, and the resulting batch is then released. The batch can subsequently be transported away by hand.

In the case of this known apparatus, it is likely to be necessary to upend the first occurring products by hand when these reach the upending plates. The following, continuously occurring products are then upended due to the upending action of the already upended products still located in the active region of the upending plates. Automatic operation is thus not ensured at least at the beginning of processing. Furthermore, the products are bent to a pronounced extent, which is not desirable in each case. Furthermore, the known apparatus is extremely complex in terms of construction and functioning.

SUMMARY OF THE INVENTION

An object of the present invention is to provide an apparatus which permits careful, automatic processing of products with a high processing capacity.

According to the invention, the products are pushed together "against the grain" and are thereby upended. In each case only a predetermined number of products are arranged on a support in an imbricated formation. This goes hand in hand with the advantage that counting of products occurring in imbricated formation or individually can be carried out simply, reliably and, in particular, independently of the thickness of the products. The invention makes use of the fact that, in an imbricated formation with a predetermined number of products, the bottom edge, which is oriented towards the support, of the product which is arranged at one end of the formation and bears on an adjacent product is freely accessible. The product arranged at the other end of the imbricated formation bears flatly on the support, with the result that the flat side of this product can also be acted upon from beneath without obstruction by other products, which ensures that this product is upended onto its bottom edge in a particularly simple and careful manner. The imbricated formation, which preferably exhibits a large degree of overlap of the products, results in careful upending of the products when the already upended product or products is being pushed in the direction of the stop. The horizontal stack thus formed with the predetermined number of products can be handled in a simple manner since the products arranged at both ends of the stack are accessible on their outer flat side at least outside the region of a stop and of an upending element. High-quality stacks are formed since, when pushed together, the products come to rest flatly against one another and can then be compressed between the stop and the upending element.

Particularly careful handling of the products is ensured if these are arranged on the support in a compacted imbricated formation. That is to say, a formation in which the products overlap virtually fully, the degree of overlap being greater in the case of thin products than for thick products. Firstly, the products are not bent, or are bent only slightly, as a result during upending and pushing together and, secondly, there is little relative movement between the products in this arrangement. Even the processing of non-flexible products is made possible as a result.

BRIEF DESCRIPTION OF THE DRAWINGS

Further advantages of the present invention can be gathered from the following description of exemplary embodiments represented in the drawing, in which, purely schematically.

DETAILED DESCRIPTION OF THE DRAWINGS

Figure 1:
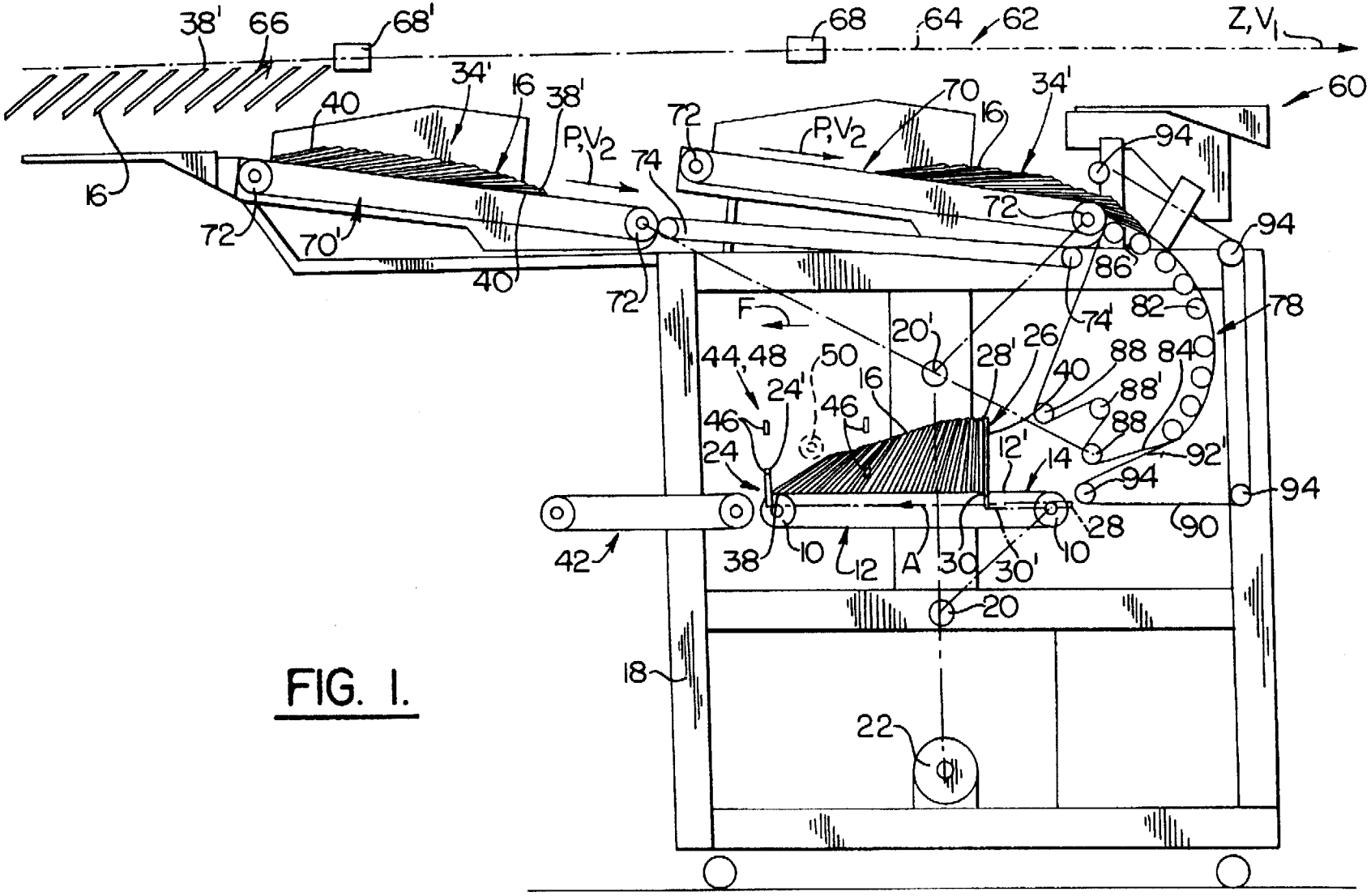
FIG. 1 shows a view of an apparatus for forming stacks exhibiting a specific number of sheet-like products, printed products, the products occurring continuously.
Figure 2:
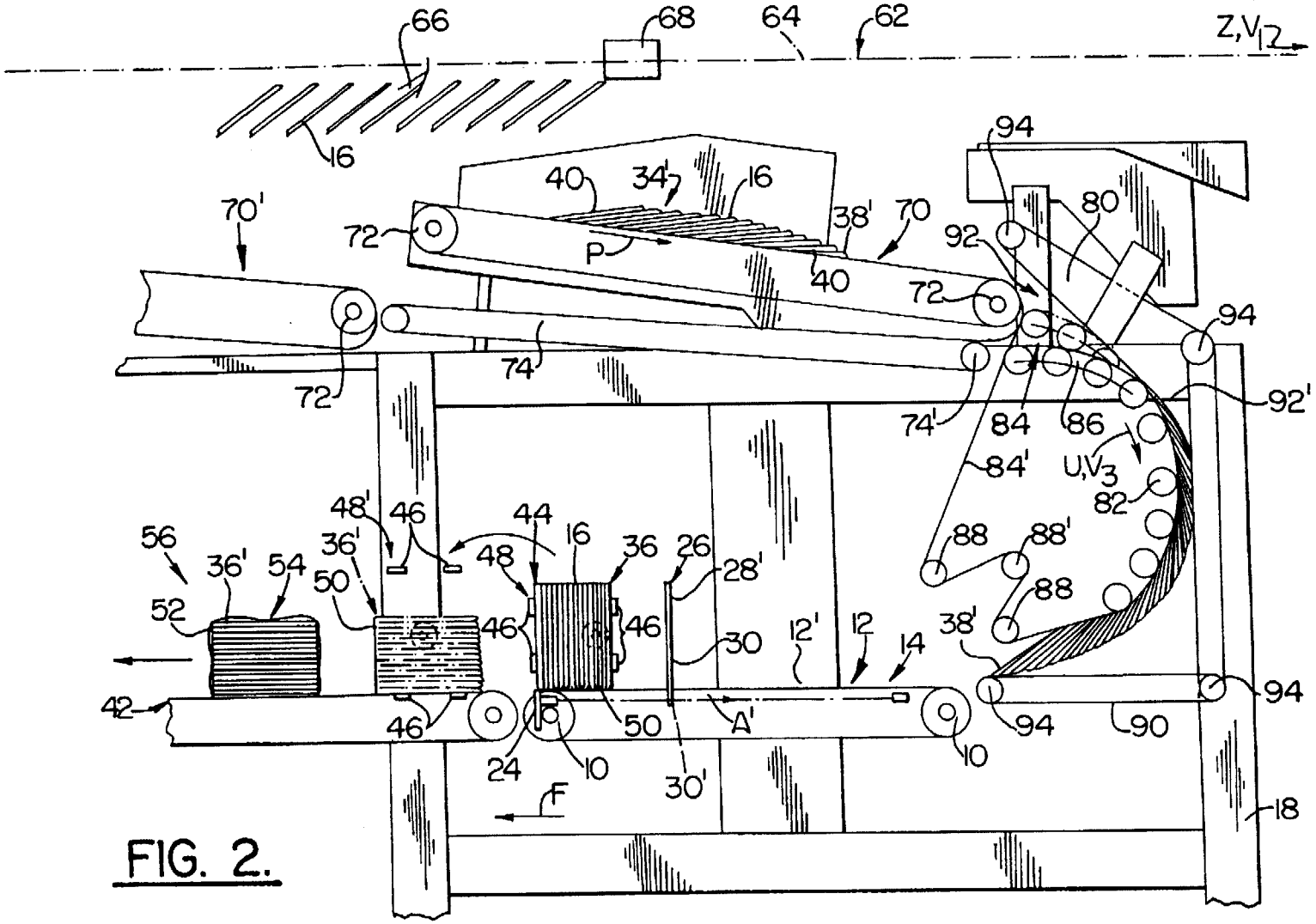
FIG. 2 shows, on an enlarged scale with respect to FIG. 1, part of the apparatus.

The apparatus according to the invention shown in FIGS. 1 and 2 exhibits an endless support belt 12 which is guided around two deflection rollers 10 and whose upper carrying strand 12' forms an approximately horizontal support 14 for printed products 16. The deflection rollers 10 are mounted rotatably on a mobile machine framework 18 and the deflection roller 10 which is arranged upstream, as seen in the conveying direction F, is, as is indicated by chain-dotted lines, connected via a controlled coupling 20 to a preferably uninterruptedly running drive motor 22. The supporting belt 12 is advantageously formed from a plurality of spaced-apart endless strips which are arranged one beside the other and are guided around rollers corresponding to the deflection rollers 10.

Arranged at the downstream deflection roller 10, i.e at the end of the support 14, is a, for example, fork-like stop element 24 which projects beyond the strand 12' and forms, with its face which is directed upstream, a stop 24' running approximately in the vertical direction.

26 designates an upending element which can be moved out of a horizontal position 28, indicated by chain-dotted lines in FIG. 1, into an upright position 28', shown in solid lines, and back again and which can be moved back and forth between a rest position, arranged in the upstream initial region of the support 14, and an end position arranged adjacent to the stop element 24.

Figure 14:
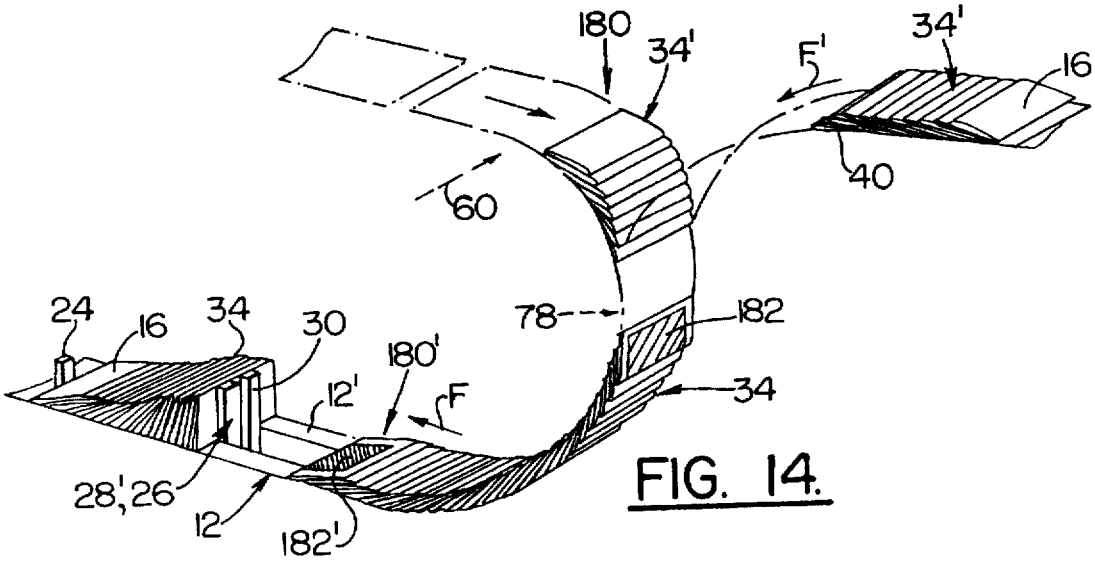
FIG. 14 shows, in perspective and in a vastly simplified manner, part of the apparatus shown in FIGS. 1 and 2, with an illustration of the position of the products in the feed device shown there and in a feed device of a different design.

As can be seen more clearly from FIGS. 3 to 7 in conjunction with FIG. 14, the upending element 26 is preferably formed by a fork-like upending lever 30, which is mounted on a carrying element 32 such that it can be pivoted about an axis 30' running parallel to the support 14 and at right angles with respect to the conveying direction F. The carrying element 32 is located beneath the upper strand 12' and can be moved back and forth between the rest position and the end position. In the horizontal position 28, the upending element 26 is located beneath the support 14 and is oriented with its free end away from the stop element 24. In the upright position 28', the upending element 26 engages through the support 14 and is located approximately at right angles with respect to the same.

In FIG. 1, a specific number of printed products 16 are arranged on the supporting belt 12, between the stop element 24 and the upending element 26, which products are to be pushed together, from an imbricated formation 34 bearing on the supporting belt 12 (FIG. 3), to form a horizontal stack 36 shown in FIGS. 2 and 5, as is described below with reference to FIGS. 3 to 5. For the time being, all that need be mentioned is that the printed products 16 are supported, with their bottom edge 38, on the supporting belt 12, the printed product which is arranged at the leading end of the formation, as seen in the conveying direction F, and bears on the adjacent printed product 16 in an imbricated manner rests, with its bottom edge 38, against the stop 24', and the printed product arranged at the opposite trailing end is supported in the face-down position on its free flat side 40 by means of the upending element 26.

A removal conveyor 42 designed as a belt conveyor adjoins the supporting belt 22, as seen in the conveying direction F. 44 indicates a stack transporter which is intended in each case for seizing, in the receiving position 48, between its jaws 46 which can be moved relative to one another, the horizontal stack 36 formed on the supporting belt 12 and for transporting said stack onto the removal conveyor 42, with simultaneous rotation about an axis of rotation which is common to the jaws 46, and discharging it there as an upright stack 36'. During discharge, the stack transporter 44 resumes a discharge position 48'.

In FIG. 2, a further upright stack 36', represented by solid lines, is arranged on the removal conveyor 42, which stack is wrapped by means of a wrapping element 52 in order to form a batch 54 which is ready for transportation. Possible embodiments of stations 56 for wrapping or strapping the stacks 36 or 36' are described below with reference to FIGS. 8 to 13.

Arranged upstream of the supporting belt 12 is a feed device 60, which is intended for forming imbricated formations 34' from printed products 16 and for feeding said formations to the supporting belt 12 in the correct position. A clamp-type conveyor 62 which is known in general is led, in an approximately horizontal direction, above and beyond the machine framework 18. It exhibits, on a drawing member 64 which is driven in circulation in the feed direction Z and at a speed $v_1$, individually controllable clamps 66 which are arranged at intervals one behind the other and are intended for retaining in each case one printed product 16, preferably at its folded edge 38' running at least virtually at right angles with respect to the feed direction Z, in a rearwardly directed oblique position and for transporting said product in said position. The clamp-type conveyor 62 exhibits two release devices 68, 68' which are arranged one behind the other and are intended in each case for opening a specific number of clamps 66 which are moved past them, in order to release the printed products 16 fed by means of said clamps 66. Arranged beneath each release device 68, 68' is in each case an identically designed belt conveyor 70, 70', of which the deflection rollers 72 are mounted on the machine framework 18. Said belt conveyors 70, 70' are always driven in circulation, in the direction of the arrow P, at a speed $v_2$ which is lower than the speed $v_1$ when the associated release device 68, 68' is activated. This results in those printed products 16 which are fed by means of the clamp-type conveyor 62 and are released at a release device 68, 68' dropping onto the corresponding belt conveyor 70, 70' and, there, forming a compact imbricated formation 34' in which the respectively first released printed product 16 bears on the belt conveyor 70, 70' with its bottom flat side 40 and with the folded edge 38' in front, in the direction of circulation P, and the following printed products 16 bear on the respectively preceding printed product 16 such that they overlap in an imbricated manner. The degree of overlap of adjacent printed products 16 is considerably larger in this imbricated formation 34' than in the imbricated formations as are formed at the output of web-fed printing machines; there is virtually full overlapping here.

The belt conveyor 70' which is located upstream of the belt conveyor 70 in the feed direction Z is adjoined by an intermediate conveyor 74 which is likewise designed as a belt conveyor, is arranged beneath the belt conveyor 70, runs approximately parallel thereto and whose downstream end 74' as seen in the arrow direction P, is arranged approximately vertically beneath the downstream end of the belt conveyor 70. The intermediate conveyor 74 and the belt conveyor 70' are connected to one another for drive purposes, with the result that the conveying speeds thereof are equal.

Arranged between the belt conveyor 70 and the intermediate conveyor 74 and the supporting belt 12 is a deflection conveyor 78 which is likewise designed as a belt conveyor and whose initial region, oriented towards the belt conveyor 70 and intermediate conveyor 74, is designed as a diverter 80, see, in particular, FIG. 2. The deflection conveyor 78 exhibits a multiplicity of deflection rollers 82 which are arranged one behind the other along an arc and guide an endless first belt 84 which establishes a deflection path through approximately 180°, this path running between the end of the belt conveyor 70 and intermediate conveyor 74 and the start, arranged vertically therebeneath, of the supporting belt 12. As can be seen from FIG. 2, the first three deflection rollers 82 following the belt conveyor 70 and intermediate conveyor 74 are mounted freely rotatably on a diverter lever 86 which can be pivoted about the axis of the fourth deflection roller 82. The diverter lever 86, with the deflection rollers 82 mounted thereon, forms a diverter tongue which can be pivoted back and forth between the belt conveyor 70 and the intermediate conveyor 74, as is indicated by chain-dotted lines and solid lines. The fourth and further deflection rollers 82 are mounted in a stationary manner on the machine framework 18. The return strand 84' of the first belt 84 is guided, in order to compensate for the length of the active strand, depending on the position of the diverter 80, in the form of an S around two stationary further deflection rollers 88 and a dancing roller 88' arranged therebetween.

A preferably elastic second belt 90 forms, together with the first belt 84, in the region of the diverter 80 an inflow 92 which tapers in the manner of a wedge and, joining this, a conveying gap 92' which, as seen in the direction of circulation U of the deflection conveyor 78, extends into the region of the last deflection roller 82. The second belt 90 is guided approximately vertically above the end of the belt conveyor 70 and, at the beginning of the supporting belt 12 and in the region of its return strand, around deflection rollers 94 which are rotatably mounted in a stationary manner on the machine framework 18.

The deflection conveyor 78 is intended for feeding to the supporting belt 12 the imbricated formations 34' formed on the belt conveyor 70 and 70', and thereby to turn over said formations 34', with the result that the previously upper side is then located at the bottom, and simultaneously to compress the printed products 16, which contributes to the subsequent formation of a high-quality stack 36, 36'.

The deflection of the imbricated formation 34' results in the fact that the printed product 16 arranged on the belt conveyor 70, 70' at the trailing end of the formation, as seen in the arrow direction P, now comes to bear on the supporting belt 12 with its previously free upper flat side 40, and the previously top folded edge 38' is now oriented towards the support 14 and now forms the bottom edge 38 in the imbricated formation 34.

As is indicated by chain-dotted lines in FIG. 1, the belt conveyors 70, 70' and the deflection conveyor 78 can be connected to the drive motor 22 via couplings with changeover gears 20', of which only one is indicated.

Figure 3:
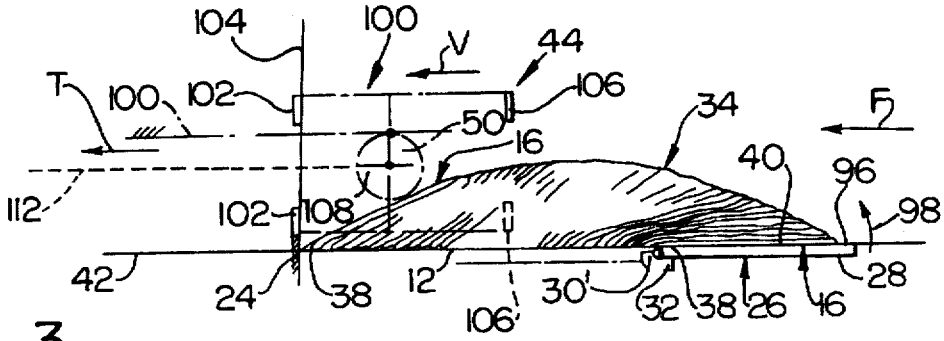
FIGS. 3 to 7 show part of the apparatus shown in FIGS. 1 and 2, at five different points in time during a cycle for forming an upright stack from products bearing upon a support in imbricated formation.

FIG. 3 shows an imbricated formation 34 bearing on the supporting belt 12 with the specific number of printed products 16, the printed products 16 bearing in an imbricated manner on the respectively following printed product 16, as seen in the conveying direction F, and the printed product 16 which is arranged at the trailing end of the imbricated formation 34 bearing, with its bottom flat side 40, on the supporting belt 12. The printed products 16 rest against the supporting belt 12 with their folded edge 38', which now forms the bottom edge 38, and the printed product 16 arranged at the front end of the imbricated formation 34, as seen in the conveying direction F, rests, with its bottom edge 38, against the stop 24'. The upending element 26 is located in the horizontal position 28 and in the initial position beneath the printed product 16 bearing, with its flat side 40, on the supporting belt 12, the axis 30' being located approximately vertically beneath the bottom edge 38 of said printed product 16. Furthermore, the carrying element 32 and its movement path are indicated by chain-dotted lines.

Arranged at the free end of the upending element 26 is a sensor 96 which is intended, while the imbricated formation 34 is conveyed by means of the supporting belt 12 towards the stop element 24, for detecting the trailing end of the imbricated formation 34 in order to position the stop element 24 in the initial position irrespective of the thickness and of the number of the printed products 16 in the imbricated formation 34.

98 designates an arrow which indicates the direction in which the upending element 26 can be pivoted from the horizontal position 28 into the upright position 28'.

The stack transporter 44 is indicated with its jaws 46 located in the receiving position 48 (see also FIGS. 1 and 2). The jaws 46 are arranged on a rotary frame 100, indicated by chain-dotted lines, which can be rotated about the axis of rotation 50. A first of the jaws 46 is formed by two jaw plates 102 which are arranged in a vertical plane 104 fixed by the stop 24'. In the receiving position of the stack transporter 44, the distance from the vertical plane 104 and the support 14 to the axis of rotation 50 is approximately equal. The other clamping jaw 46 is likewise formed by two further jaw plates 106, which can be moved out of a depicted open position, in the direction of the arrow K, towards the jaw plates 102; into a clamping position and back again. The jaw plates 102 and 106 can be moved, in the direction at right angles with respect to the plane of the drawing, out of a retaining position, in which they project from the sides of the supporting belt 12 into the region above the supporting belt 12, into a retracted position outside this region and back again. In FIG. 3, the jaw plates 102 are located in the retaining position and further jaw plates 106 are located in the retracted position.

The rotary frame 100 is connected to a gear wheel 108 which is coaxial with respect to the axis of rotation 50 and meshes with a toothed rack 110, arranged above the gear wheel 108 and running parallel to the support 14, this resulting in the fact that, when the axis of rotation 50 is moved out of the receiving position 48 in the transporting direction T, along the path 112 which is indicated by dotted lines and runs parallel to the supporting belt 12, into the discharge position 48', this leads to the rotary frame 100, with the jaw plates 102 and 106, being rotated through 270° in the clockwise direction.

FIGS. 4 to 7 show the same parts of the apparatus as FIG. 3 at different points in time during a cycle. The same parts are designated by the same reference symbols as in FIG. 3. The figures are thus only described in as much detail as is necessary for understanding.

Figure 4:
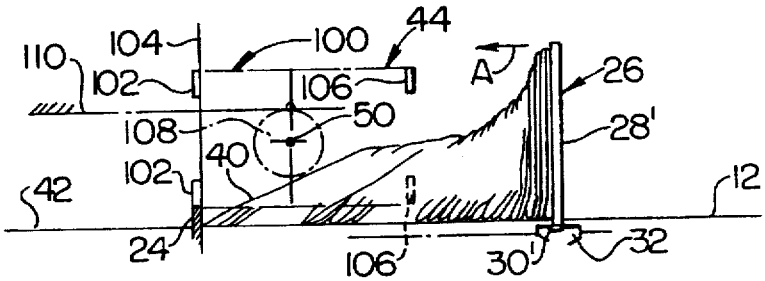

In FIG. 4, all the apparatus parts shown there assume the same position as in FIG. 3, with the exception that the upending element 26 has been pivoted out of the horizontal position 28, shown in FIG. 3, in the direction of the arrow 98 into the upright position 28', as a result of which the printed product 16 arranged at this end of the imbricated formation 34 and some of the following printed products 16 have been upended, with the result that they stand, with their bottom edge 38, on the supporting belt 12. The printed products 16 which follow in the direction of the stop element 24 are positioned with a progressively smaller gradient, while the printed product 16 arranged at the stop-side end and a number of the printed products 16 following this have maintained their original position intact. If the carrying element 32, together with the upending element 26 located in the upright position 28', is then moved in the pushing-together direction A towards the stop element 24, gradually all the printed products 16 are upended onto their bottom edge 38; with the result that they form a horizontal stack 36 with printed products 16 which rest against one another over the entire surface area and stand, with their bottom edge 38, on the supporting belt 12. In this arrangement, the printed product 16 arranged at the stop-side end comes to rest, with its free flat side 40, against the jaw plates 102, as a result of which the horizontal stack 36 formed is retained in a stable manner between said jaw plates 102 and the stop element 24. In order to control the displacement of the carrying element 32 and thus of the stop element 24, it is conceivable to activate the drive thereof in a force-dependent manner, with the result that the movement in the pushing-together direction A is stopped as soon as a specific reaction force is exerted by the horizontal stack 36 which has been formed. On the other hand, it is also conceivable, for this purpose, to monitor the position of the printed product 16 resting against the stop element 24 and stop movement in the transporting direction T as soon as this has been upended. Consequently, different numbers of printed products 16 of any thickness can be stacked in a simple manner.

Figure 5:
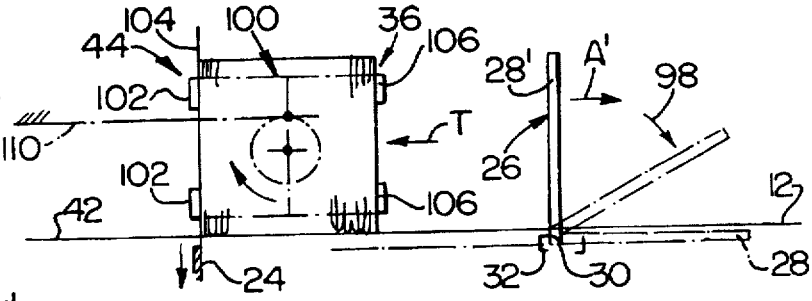

FIG. 5 shows the formed horizontal stack 36, which is now retained between the jaw plates 102 and further jaw plates 106. For this purpose, in that position of the stack transporter 44 which is shown in FIG. 4, the further jaw plates 106 have been extended into the retaining position and applied in the clamping direction K onto the printed product 16 retained by the stop element 24. As can be seen from FIG. 5, the carrying element 32 is then moved back in arrow direction A', which is counter to the pushing-together direction A, into the rest position and, at the same time, the upending element 26 is pivoted in the direction of the arrow 98' into the horizontal position 28. The downwardly oriented arrow at the stop element 24 shows that the latter has been drawn back beneath the supporting belt 12. The arrow T indicates that the rotary frame 100 is moved out of its receiving position 48, with simultaneous rotation through 270° in the clockwise direction, into the discharge position 48', which is arranged, with respect to the stop element 24, on the other side from the receiving position 48 and in the region of the removal conveyor 42.

Figure 6:
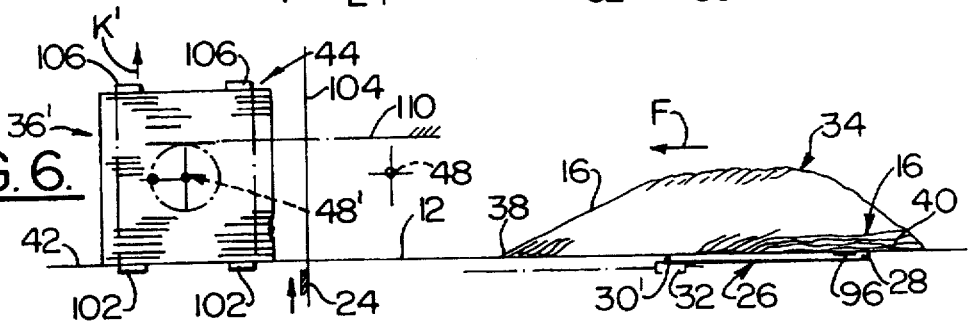

FIG. 6 shows the stack transporter 44 in the discharge position 48'. In this arrangement, the jaw plates 102 are located in the plane of the removal conveyor 42 and the further jaw plates 106 are located vertically above them. The upright stack 36' is now released by raising the further jaw plates 106 in the direction of the arrow K' and drawing back all the jaw plates 102 and 106 into the retracted position. The arrow at the stop element 24 shows that the latter is raised to project beyond the supporting belt 12 again. Located on the supporting belt 12 is a further imbricated formation 34, which is transported in the conveying direction F by means of the supporting belt 12 until the printed product 16 arranged at the leading end rests, with its bottom edge 38, against the stop element 24. If the trailing end of the imbricated formation 34 passes over the sensor 96 (see FIG. 3), the carrying element 32 is immediately driven in the conveying direction F at the same speed as the supporting belt 12, as a result of which it is ensured that, with the imbricated formation 34 resting against the stop element 24, the upending element 26 assumes its initial position beneath the printed product 16 resting, with its flat side 40, on the supporting belt 12, as is shown in FIGS. 3 and 7.

Figure 7:
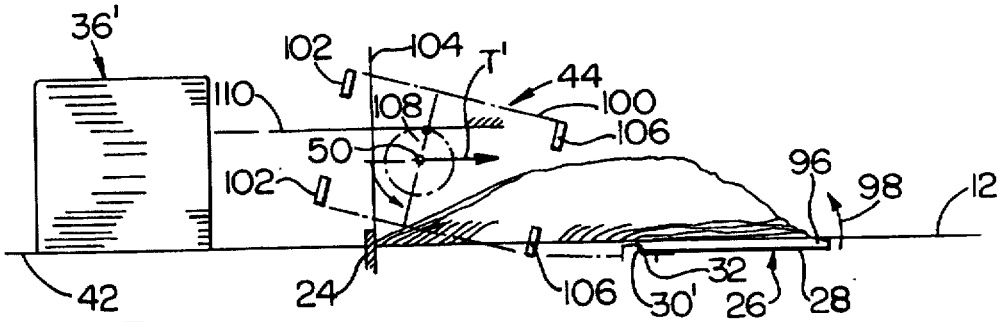

In FIG. 7, the supporting belt 12 has brought the imbricated formation 34 shown in FIG. 6 to rest against the stop element 24 and is then brought to a standstill. The upending element 26 is located in the initial, horizontal position 28. The imbricated formation 34 exhibits a specific, but smaller, number of printed products 16 than the imbricated formation 34 shown in FIG. 3. However, the upending element 26 automatically assumes the correct initial position since its position is controlled with the aid of a sensor 96. The arrow 98 indicates that the upending element 26 is then ready to be pivoted into the upright position 28', in order to form once again a horizontal stack 36 from the imbricated formation 34. As is shown by the arrow T' directed counter to the transporting direction T, the stack transporter 44 is moved back into the receiving position 48, with simultaneous rotation of the rotary frame 100 through 270° in the anti-clockwise direction. The jaw plates 102 are moved into the retaining position again and, finally, come to lie in the vertical plane 104 again, as a result of which the initial position shown in FIG. 3 is reached again. The upright stack 36' which is formed is then transported away in the conveying direction F by means of the removal conveyor 42.

Figure 8:
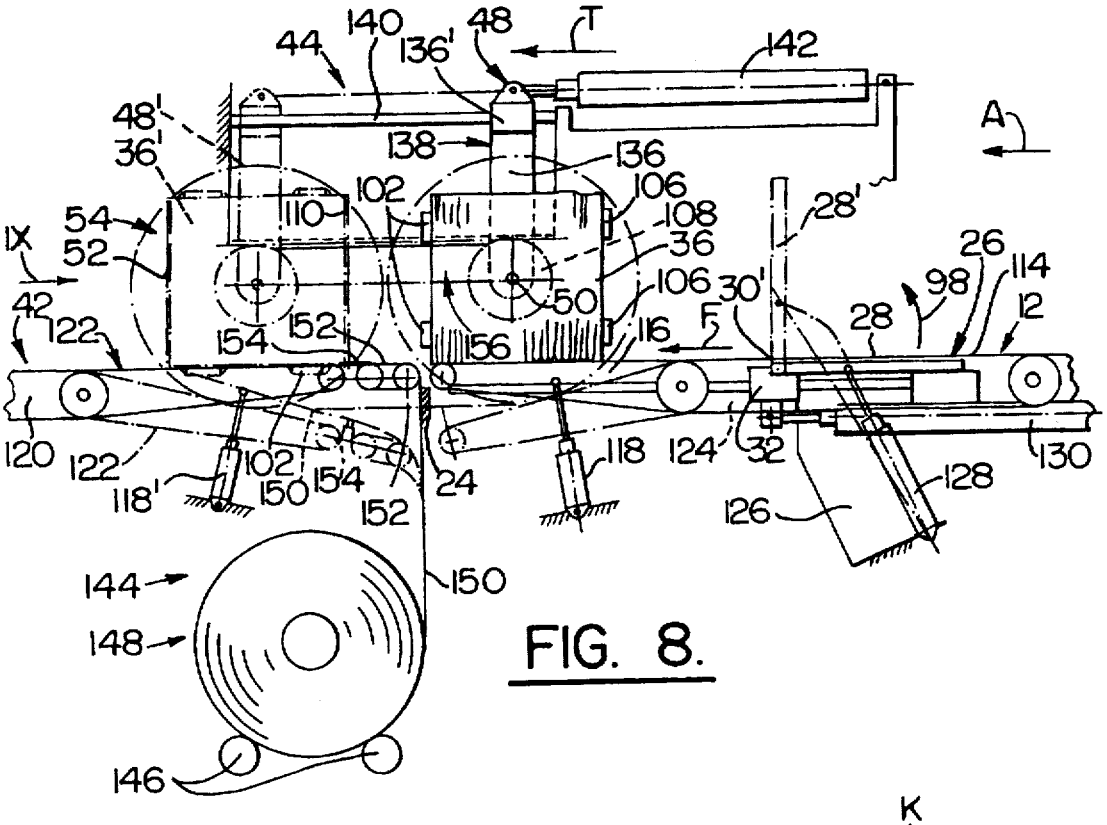
FIG. 8 shows, on enlarged scale, part of the apparatus shown in FIGS. 1 and 2, with an integrated device for wrapping the formed stack by means of a wrapping element.

FIG. 8 shows, inter alia, a possible solution for the problem which exists in the usage of a stack transporter 44, as shown in the figures, where upon moving a stack 36 from the supporting belt 12 to the removal conveyor 42 in each case, a region of the stack moves through beneath the approximately horizontal plane defined by the supporting belt 12 and the removal conveyor 42. For this purpose, the supporting-belt conveyor 12 is subdivided into two sub-conveyors, namely a stationary supporting belt sub-conveyor 114 and a second supporting belt sub-conveyor 116 which adjoins the first one directly in the conveying direction F and can be pivoted by means of a piston/cylinder unit 118 out of a supporting position, in which its upper strand is in alignment with that of the first supporting belt sub-conveyor 114, into a bottom end position indicated by chain-dotted lines. In the same way, the removal conveyor 42 is subdivided into a stationary first removal sub-conveyor 120 and a pivotable second removal sub-conveyor 122. In the same way as for the second supporting belt sub-conveyor 116, the free end, in the case of the second removal sub-conveyor 122, is also oriented towards the stop element 24. The piston/cylinder unit for pivoting the second removal sub-conveyor 122 is designated by 118'. The second removal sub-conveyor 122 is shown in solid lines in its operating position for receiving and transporting away an upright stack 36', and it is shown in chain-dotted lines in its downwardly pivoted retracted position.

It can also be seen clearly in FIG. 8 that the carrying element 32 is designed as a carriage guided on guide rails 124 and exhibits a carrier plate 126 on which one end of a piston/cylinder drive 128 is articulated, the other end thereof acting on the upending element 26 in order to pivot the latter, about the axis 30', in the direction of the arrow 98 from the horizontal position 28 into the upright position 28' and back again. A piston/cylinder drive 130, which acts on the machine framework 18 at one end, is fastened on the carrying element 32 at the other end in order to move the latter in a controlled manner along the guide rails 124 in and counter to the pushing-together direction A.

Figure 9:
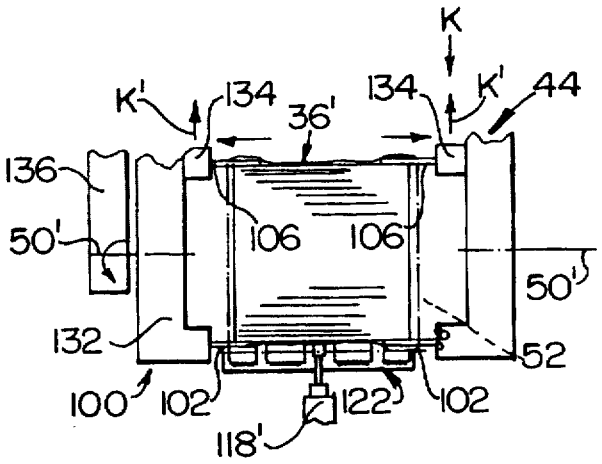
FIG. 9 shows part of the apparatus shown in FIG. 8, in a side view in the direction of the arrow IX.

Taking FIGS. 8 and 9 in conjunction, the construction of the stack transporter 44 can be seen in more detail. The rotary frame 100 exhibits two sub-frames 132 which are each arranged on one side of the supporting belt 12 and removal conveyor 42 and are seated in a rotationally fixed manner on shafts 50', indicated by chain-dotted lines, which fix the axis of rotation 50. On the one hand, two jaw plates 102 at a fixed spacing with respect to the shafts 50' are arranged on each sub-frame 132 and, on the other hand, there are displaceably guided jaw carriages 134 which can be moved in the clamping direction K towards the jaw plates 102 and away from the same in the opposite direction K' and on which the further jaw plates 106 are arranged. FIG. 9 shows all the jaw plates 102, 106 in their retaining position, in which they secure a stack 36' between them. Drive elements (not shown) are arranged in the sub-frames 132 in order to draw back the jaw plates 102, 106 into the retracted position and to extend them into the retaining position. A wrapping element 52 running around the stack 36' is indicated by chain-dotted lines.

The two shafts 50' are each mounted rotatably on a leg 136 of a U-shaped, downwardly open carrying bracket 138. Furthermore, seated on the shafts 50' in a rotationally fixed manner is in each case one gear wheel 108 which interacts with corresponding toothed racks 110 fastened on the machine framework 18. The carrying bracket 138 is mounted in the manner of a carriage on guide rods 140 by means of its crossmember 136', connecting the two legs 136, and can be moved in and counter to the transporting direction T by means of a piston/cylinder drive 142 fastened on the machine framework 18 at the other end.

Furthermore, it can be seen from FIG. 9 that the second removal sub-conveyor 122 is designed as a strip conveyor whose outer strips are designed to give a smaller width than the inner strips and with a smaller degree of prestressing, in order to make it readily possible to draw back the jaw plates 102.

Furthermore, the apparatus according to FIG. 8 exhibits a delivery device 144 for wrapping elements 52. Arranged beneath the second removal sub-conveyor 122 is a bearing element 146 for freely rotatably receiving a supply roll 148 with a wound-up wrapping-element web 150. Furthermore, the delivery device 144 exhibits, between the free end of the second removal sub-conveyor 122 and the stop element 24, a freely rotatable strip-type circulating conveyor 152 whose deflection rollers for the strips are mounted on the plates (not shown) of the second removal sub-conveyor 122. Consequently, the strip-type circulating conveyor 152 can be pivoted together with the second removal sub-conveyor 122. Arranged between the strip-type circulating conveyor 152 and the second removal sub-conveyor 122 is a cutting device 154 for example with a heating wire, which is intended for severing a wrapping element 52 from the wrapping-element web 150 in each case.

The wrapping-element web 150, indicated by a solid line, runs from the supply roll 148 upwards approximately in the vertical direction and runs through between the stop element 24 and the strip-type circulating conveyor 152, whereupon it is held in a manner clamped in, by means of an end section 156, between the horizontal stack 36 and the jaw plate 102 which is at the bottom in the receiving position 48 of the stack transporter 44.

Chain-dotted lines show the stack transporter 44 in discharge position 48', the transporter then retaining the upright stack 36'. In this arrangement, the end section 156 of the wrapping-element web 150 is clamped in between the now upright stack 36' and that jaw plate 102 of the two jaw plates 102 which is nearer the stop element 24. From there, the wrapping-element web 150 runs in the anticlockwise direction along three sides of the upright stack 36' and, from that edge of the stack 36' which is shown at the bottom left, runs on in a slightly tensioned state via the cutting device 154 and the strip-type circulating conveyor 152; in this arrangement, the second removal sub-conveyor 122 has been pivoted into the bottom end position.

Figure 10:
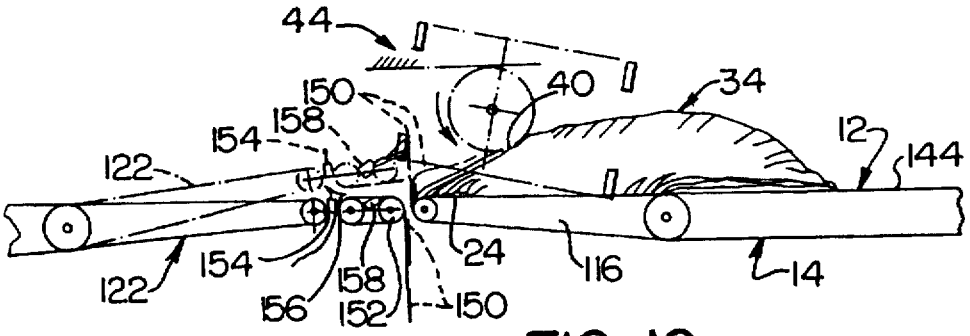
FIG. 10 shows, in the same representation as in FIG. 8, the part of the apparatus shown there at two points in time during the application of an end section of a wrapping element onto the imbricated formation.

As can be seen from FIG. 10, the delivery device 144 further exhibits, between the two deflection rollers of the strip-type circulating conveyor 152, an air-nozzle arrangement 158 whose jet is directed beyond the deflection roller oriented towards the stop element 24. Solid lines show the progression of the wrapping-element web 150 taken after a wrapping element 52 has been severed. In this arrangement, the web end section 156 is located on the strip-type circulating conveyor 152 and its end is located at the cutting device 154. It can further be seen that the second removal sub-conveyor 122 can be pivoted, together with the strip-type circulating conveyor 152 and the cutting device 154, out of the horizontal position by means of the piston/cylinder unit 118' into an obliquely upwardly running wrapping element applying position. As is indicated by chain-dotted lines, the air-nozzle arrangement 158 is activated as the second removal sub-conveyor 122 and strip-type circulating conveyor 152 are pivoted upwards, as a result of which the end section 156 is separated from the strip-type circulating conveyor 152 and folded over, with the result that it then rests against the free flat side 40 of the printed product 16 resting against the stop element 124, said printed product 16 belonging to the imbricated formation 34 bearing on the supporting belt 12. As can be seen, in particular, from the position of the stack transporter 44, the latter has not yet quite reached its receiving position 48; the point of time of a cycle which is represented in FIG. 10 corresponds to that of FIG. 7.

Figure 11:
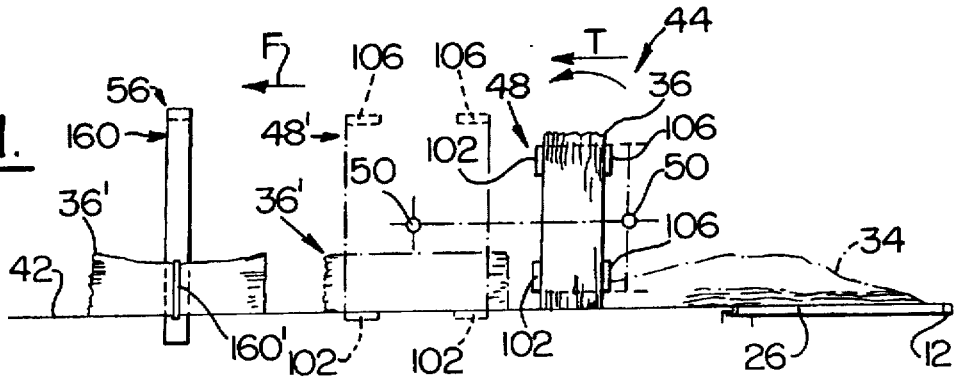
FIG. 11 shows part of the apparatus shown in FIGS. 1 and 2, with a strapping device.

In FIG. 11, the supporting belt 12 and the removal conveyor 42 are represented in simplified form as a plane. Chain-dotted lines indicate an imbricated formation 34 which is located on the supporting belt 12 and is pushed together to form a horizontal stack 36 by the interaction of the stop element 24 (not shown) and the upending element 26, as has been described above. The stack transporter 44 retains the horizontal stack 36 by means of its jaw plates 102 and 106. Chain-dotted lines show the stack transporter 44 in the discharge position 48', the now upright stack 36' bearing on the removal conveyor 42. While being moved from the horizontal into the upright position, the stack has been rotated through 90° in the counterclockwise direction in addition to the translatory transportation in the transporting direction T, as is indicated by the arrow. As seen in the conveying direction F, a strapping unit 160 is arranged downstream of the stack transporter 44, which unit 160 is intended for positioning a strap or a band 160' around the upright stack 36', which has been fed to it in each case by means of the removal conveyor 42, and connecting said strap or band to form a closed loop.

Figure 12:
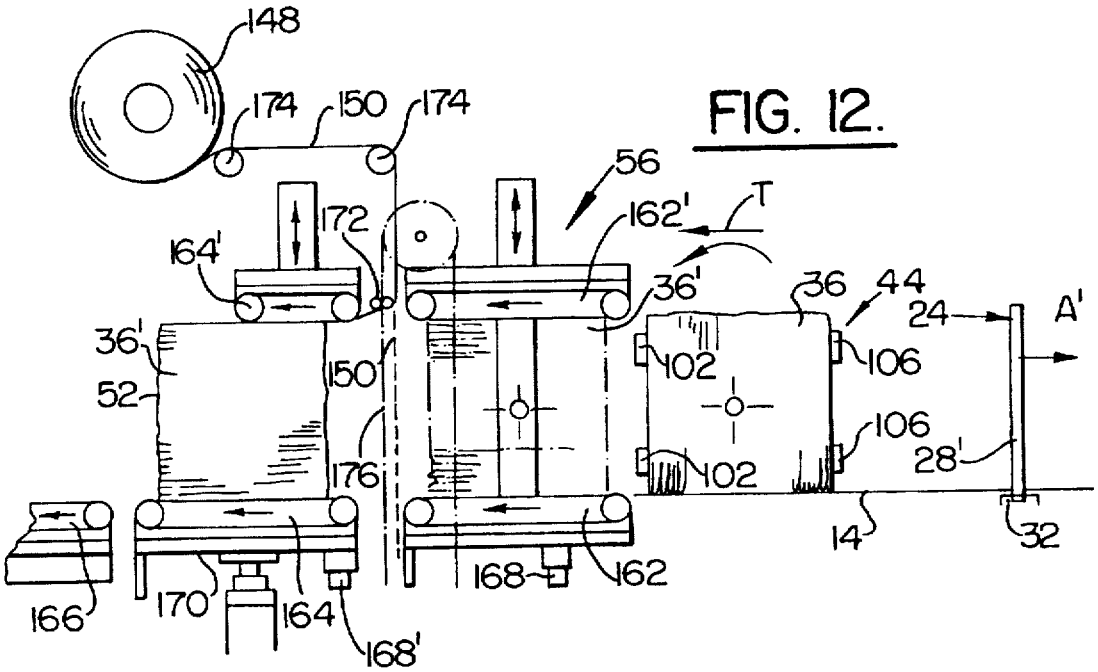
FIG. 12 shows part of the apparatus shown in FIGS. 1 and 2, with a wrapping station for wrapping the formed stack by means of a wrapping element.

FIG. 12 shows, schematically, the support 14 on which there is arranged a horizontal stack 36 formed from an imbricated formation 34. Said stack is retained by the jaw plates 102 and 106 of the stack transporter 44. The upending element 26, shown in the upright position 28', is moved back into the rest position by displacing the carrying element 32 counter to the pushing-together direction A, in the direction of the arrow A'.

As seen in the transporting direction T of the stack transporter 44, a station 56 for wrapping stacks 36' is arranged downstream of the support 14, as is known from EP-A-0 120 251 and the corresponding U.S. Pat. No. 4,738,078, each of which is incorporated herein by reference. As far as the construction and the mode of functioning of said station 56 are concerned, you are expressly referred to these documents. The removal conveyor 42 is formed by three belt conveyors 162, 164 and 166 arranged one behind the other. Arranged above the belt conveyor 162 is a further belt conveyor 162' which can be raised and lowered in the direction of the double arrow by means of a lifting device 168. The belt conveyors 162 and 162' can be driven in the arrow direction.

The belt conveyor 164 is arranged on a turntable 170 which can be rotated through 180° about a vertical axis in each case. Arranged above the belt conveyor 164 is a further belt conveyor 164' which can be raised and lowered by means of a further lifting device 168' and can be rotated together with the turntable 170. The two belt conveyors 164 and 164' can be driven in both directions. The third belt conveyor 166 is located at the same level as the two upstream belt conveyors 162 and 164 and can be driven in the arrow direction.

The upright stack 36', indicated by chain-dotted lines between the two belt conveyors 162 and 162', indicates that the horizontal stack 36 arranged on the support 14 is fed to the belt conveyor 162 by means of the stack transporter 44, the further belt conveyor 162' being raised into its uppermost end position for this purpose. Before the jaw plates 102 and 106 are drawn back, the further belt conveyor 162' is then lowered onto the upright stack 36' in order to compress the same.

Shown between the belt conveyor 164 and the further belt conveyor 164' is an upright stack 36' which, on its underside, its front side and upper side, is enclosed by a section of the wrapping-element web 150 which runs from the further belt conveyor 164', around a driver element 172 and guide rollers 174, to a supply roll 148 which is rotatably mounted in a stationary manner above the further belt conveyor 164'. The driver element 172 is fastened on a drive member 176, indicated by chain-dotted lines, by means of which the driver element can be moved in a vertical direction from a top end position to a bottom end position and back again.

In order to wrap the upright stack 36' compressed between the belt conveyors 162 and 162', said belt conveyors are driven in the arrow direction, as a result of which the stack 36' carries along the wrapping-element web 150 which intersects its movement path, as indicated by chain-dotted lines and, when the stack 36' runs in between the belt conveyor 164 and the further belt conveyor 164' which is lowered to the same level as the belt conveyor 162', is applied to three sides of the stack 36', as is shown by solid lines. The driver element 172 is then moved from its top end position into the bottom end position, whereupon the wrapping-element web 150 forms a loop on the rear side of the stack 36'. Beneath the plane fixed by the belt conveyors 162, 164, 166, said loop is then severed in order to separate off a wrapping element 52 and, at the same time, to ensure that the wrapping-element web 150 again intersects the movement path of a next incoming stack 36'. The turntable 170 is then rotated through 180°, as a result of which, upon transportation of the stack 36' onto the belt conveyor 166, that section of the wrapping element 52 which now hangs freely on the front side of the stack 36' is folded over around the underside of the stack 36. A manageable batch 54 comprising an upright stack 36' wrapped by means of a wrapping element 52 is then ready, on the belt conveyor 166, for transporting away.

Figure 13:
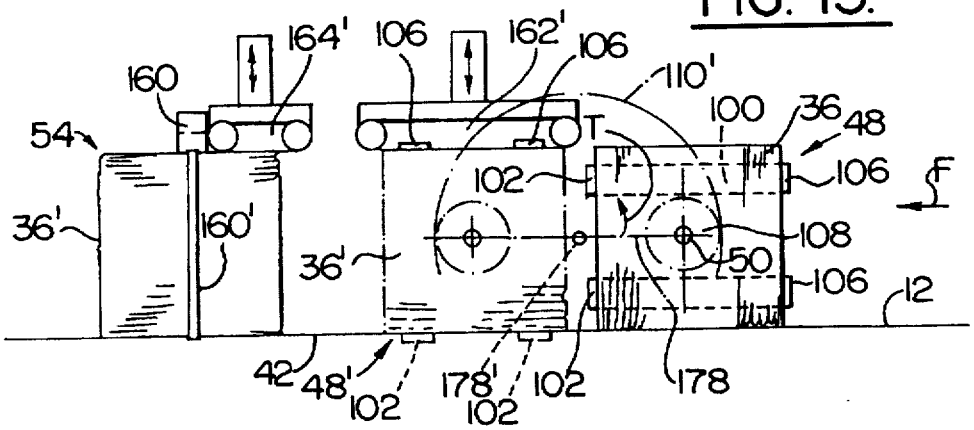
FIG. 13 shows a device, similar to FIG. 12, for strapping the stack.

FIG. 13 shows, in particular, an embodiment which differs from the stack transporter 44 described above. Jaw plates 102 and 106 are arranged, as described above, on the rotary frame 100 which can be rotated about the axis of rotation 50. Said jaw plates are intended for retaining a formed horizontal stack 36 arranged on the supporting belt 12. The rotary frame 100 is arranged freely rotatably at the free end of a transmission lever 178, mounted on the machine framework 18 such that it can be rotated about the bearing axis 178', and is connected to a gear wheel 108 which interacts with a toothed rack 110' which is coaxial with respect to the bearing axis 178' and extends through an angle of approximately 180°. The toothed rack 110' reaches, from the top, around the gear wheel 108 and the transmission-lever axis 178' arranged in the direction F between the supporting belt 12 and the removal conveyor 42. In the receiving position 48 shown by solid lines in FIG. 13, the transmission lever 178 runs approximately parallel to the supporting belt 12 and is pivoted through 180° in the anticlockwise direction, in the direction of the arrow T, in order to pass into the discharge position 48' indicated by chain-dotted lines. During this rotary movement, the gear wheel 108 rolls on the toothed rack 110', as a result of which the stack 36 is rotated through 270° in the clockwise direction. In the discharge position 48', the jaw plates 102 are, in turn, arranged level with the removal conveyor 42 and the further jaw plates 106 are arranged above these. After the jaw plates 106 have been raised and all the jaw plates 102 and 106 have been drawn back, in the direction at right angles with respect to the plane of the drawing, into the retracted position, the receiving position 48 can be reached again by the transmission lever 178 being rotated in the clockwise direction.

This embodiment of the stack transporter 44 has the advantage that it is not necessary to design the supporting belt 12 and the removal conveyor 42, as is shown in FIG. 8, such that they can be pivoted away downwards, since the horizontal stack 36 is raised from the supporting belt 12 and, as upright stack 36', is lowered from above onto the removal conveyor 42.

Located above the discharge position 48' of the stack transporter 44 is a further belt conveyor 162', which can be raised and lowered by means of a lifting device in the same manner as the corresponding belt conveyor 162' shown in FIG. 12. This belt conveyor 162' is located in its top end position in each case when the stack transporter 44 transports a stack 36 to the removal conveyor 42. Before the jaw plates 102, 106 are drawn back, it is lowered onto the upright stack 36' in order to compress the same. As seen in the conveying direction F, the further belt conveyor 162' has arranged downstream of it a further belt conveyor 164' which corresponds to the further belt conveyor 164' of FIG. 12 and can likewise be raised and lowered by means of a lifting device (not shown), said further belt conveyor 164' conventionally being located at the same level as the further belt conveyor 162'. Arranged downstream, directly adjacent to the further belt conveyor 164', is a strapping unit 160 which is known in general.

If the removal conveyor 42 and the further belt conveyors 162', 164' are driven in the conveying direction F, a compressed upright stack 36' located between the removal conveyor 42 and the further belt conveyor 162' is fed to the belt conveyor 164' and transported further until such time as it assumes the position represented by solid lines, as seen in the conveying direction F, in which position approximately half of it is free downstream of the further belt conveyor 164', with the result that the strapping unit 160 can then apply a strap or a band 160' around the stack 36'. When the next stack 36' is fed, the stack 36' which has been provided with straps to form a batch 54 is then conveyed away out of the region of the further belt conveyor 164'.

FIG. 14 shows, schematically, the upper strand 12' of the supporting belt 12 formed, in this case, by two parallel belts. The upending element 26, designed as a forked upending lever 30, projects through between the two belts and beyond the supporting belt 12, in the upright position 28'. The stop element 24 is shown downstream of the upending element 26, as seen in the conveying direction F. Located between said stop element 24 and the upending element 26 is an imbricated formation 34 whose printed products 16 are pushed together to form a horizontal stack 36, as is shown in FIGS. 3 to 5.

Located one behind the other in the feed device 60 are three imbricated formations 34', and it can be seen particularly clearly that the order within the imbricated formations 34' remains intact in the deflection conveyor 78, but the formations are reversed such that the underside becomes the upper side. Arrows 180 and 180' designate cover-sheet feed devices which are arranged upstream and downstream, respectively, of the deflection conveyor 78. The cover-sheet feed device 180 arranged upstream of the deflection conveyor 78 is intended for positioning a cover sheet 182 onto the printed product 16 arranged at the trailing end of the imbricated formation 34', whereas, by means of the cover-sheet feed device 180' arranged downstream of the deflection conveyor 78, a cover sheet 182' can be deposited onto the printed product 16 arranged at the leading end of the imbricated formation 34.

Figure 15:
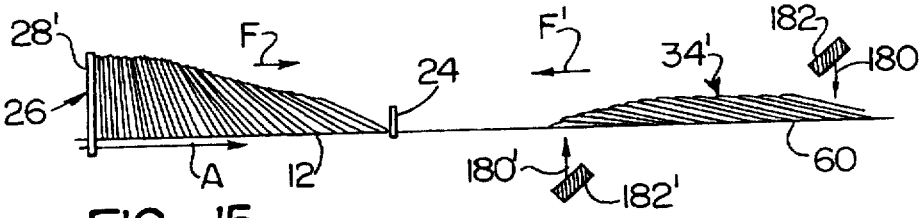
FIG. 15 shows, schematically, the pushing-together of the products to form a stack when they are fed to the support by a different feed device shown in FIG. 14.

An alternative embodiment of the feed device 60 is indicated by an imbricated formation 34' shown by chain-dotted lines. This imbricated formation 34' exhibits a specific number of printed products 16, in which the printed products 16 each bear in an imbricated manner on the preceding product, with the exception of the printed product 16 arranged at the leading end of the formation. As can easily be seen, the imbricated formation 34' is fed to the supporting belt 12 in the direction F' without reversing the underside to the upper side. This is illustrated again schematically in FIG. 15. Cover-sheet feed devices 180, 180' for positioning a cover sheet 182, 182' on the top or bottom may likewise be arranged in the region of the feed device 60. As can further be seen from FIG. 15, in the case of an apparatus according to the invention for processing such imbricated formations 34', the upending element 26 is arranged downstream of the stop element 24, as seen in the conveying direction F'. During the feed of the imbricated formation 34', the stop element 24 is lowered beneath the supporting belt 12' and is raised as soon as the printed product 16 arranged at the trailing end of the formation 34, as seen in the conveying direction F', has passed the stop element 24. The supporting belt is then reversed and driven in the conveying direction F until the imbricated formation rests against the stop element 24. In the same manner as has been described above, a horizontal stack is formed from the imbricated formation 34' by moving the upending element 26 into the upright position 28' and pushing the printed products 16 together against the grain in the pushing-together direction A, which horizontal stack can be further processed, as has been described above.

Figure 16:
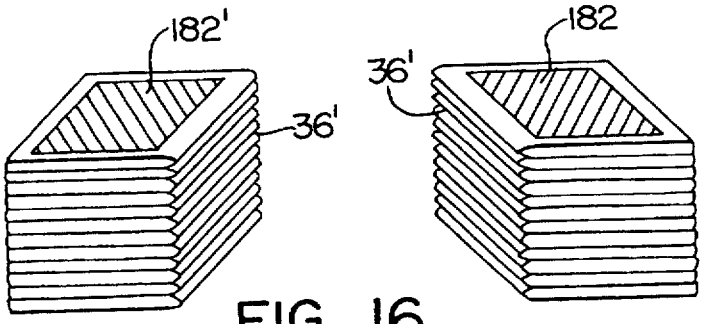
FIG. 16 shows, in perspective, two different upright stacks, formed by the apparatus according to the invention, with cover sheet.

FIG. 16 shows two upright stacks 36' with a now top cover sheet 182' and 182 fed from the cover-sheet feed devices 180 and 180'. Depending on the feed method selected and the desired rotation of the horizontal stack 36 to form an upright stack 36', one or the other cover sheet 182, 182' is located at the top.

As can be seen from FIG. 1, imbricated formations 34' are formed alternately on the two belt conveyors 70, 70' from in each case a specific number of printed products 16 fed by means of the clamp-type conveyor 62. As soon as such a formation 34' is ready, the corresponding belt conveyor 70, 70' is emptied in that it, if appropriate with the intermediate conveyor 74, and the deflection conveyor 78 are driven at a speed $v_3$ which is greater than the speed $v_1$ and $v_2$. In this arrangement, the speeds and conveying paths are matched to one another such that the deflection conveyor 78 can act as a buffer in order temporarily to store an imbricated formation 34' until the supporting belt 12 is free to receive said imbricated formation 34. As soon as this is the case, the deflection conveyor 78 and the supporting belt 12 are driven at the same speed in the conveying direction F until the entire imbricated formation 34 bears on the supporting belt 12 and rests against the stop element 24 with the bottom edge 38 of its foremost printed product 16, as seen in the conveying direction F. At this point in time, the deflection conveyor 78 is ready to receive a further imbricated formation 34'.

As can be seen from FIGS. 3 to 5 and is described above, a horizontal stack 36 is then formed from the imbricated formation 34 located on the supporting belt 12, which horizontal stack 36 is fed to the removal conveyor 42 by means of the stack transporter 44. If the stack transporter 44 is designed as shown in FIGS. 3 to 10, the supporting belt 12 and the removal conveyor 42 or parts thereof, such as the second supporting belt sub-conveyor 116 and the second removal sub-conveyor 122, can be pivoted away downwards out of the pivot region of the stack, as can be seen from FIG. 8. As soon as the stack transporter 44 is located, with the now upright stack 36', in the discharge position 48', the downwardly pivoted conveyors are pivoted into their horizontal position again. After the release of the upright stack 36' by the jaw plates 102, 106 being drawn back, the stack 36' can then be conveyed away and strapped or wrapped, as is shown in FIGS. 11 to 13.

If the stacks are to be wrapped during transportation by means of the stack transporter 44, then, as can be seen from FIG. 10, the end section 156 of the wrapping-element web 150 is applied to the flat side 40 of the printed product 16 resting against the stop element 24. When the printed products 16 are pushed together to form a horizontal stack 36, the end section 56 is then clamped fixedly between the stack 36 and the relevant jaw plate 102. Subsequently, the second supporting belt sub-conveyor 116 and the second removal sub-conveyor 122 are pivoted downwards and the stack transporter 44 is moved into the discharge position 48'. Since, in this arrangement, the stack is rotated through 270° in the clockwise direction, the wrapping-element web 150 then runs around the now upright stack 36', as is indicated by chain-dotted lines in FIG. 8. Upon subsequent raising of the second removal sub-conveyor 122, that section of the wrapping-element web 150 which extends through beneath the stack 36' is applied to the bottom of the stack 36'. Thereafter, the wrapping-element web 150 is severed, by means of the cutting device 154, in the vicinity of the rear bottom edge of the stack 36', as seen in the transporting direction T, as a result of which an end section 156 of the wrapping-element web 150 then rests against the strip-type circulating conveyor 152 again and is ready for applying to the next fed imbricated formation 34. Before the stack 36' provided with a wrapping element 52 can be conveyed away by the first and second supporting belt sub-conveyors 114, 116 being driven, the jaw plates 102 and 106 are drawn back into their retracted position, as is indicated by the arrows in FIG. 9. The stack transporter 44 can then be moved back into its receiving position 48 again, whereupon the next horizontal stack 36 can be formed.

The wrapping-element web 150 is preferably self-adhesive on one side, to be precise on the side remote from the stacks 36. This ensures that, on the one hand, the mutually overlapping sections automatically adhere to one another and, on the other hand, the jaw plates 102, 106 can be readily drawn back even if the wrapping element 52 is positioned around them, as is shown in FIG. 9.

The arrangement of the belt conveyors 70, 70' above the supporting belt 12 results in a compact apparatus which requires little space. It would also be conceivable to arrange two apparatuses, shown in FIGS. 1 and 2, without belt conveyor 70' one behind the other along the clamp-type conveyor 62 and to supply said apparatuses alternately with a specific number of printed products 16. In this case too, the clamp-type conveyor 62 could convey printed products 16 continuously. It would, of course, also be conceivable for the printed products 16 to be fed to the supporting belt 12 directly from the clamp-type conveyor 62. In this case, the supporting belt 12 would be arranged in place of the belt conveyor 70.

Finally, it should be mentioned that it is quite conceivable to feed printed products 16 to the supporting belt in an imbricated formation with a small degree of overlap and to provide means on said supporting belt in order to increase the overlap of the printed products and thus to form a compacted imbricated formation before the pushing-together operation.

The examples described have shown the processing of folded multiple-sheet printed products, such as newspapers, periodicals and the like, as can take place in despatch rooms of printing works. It is, however, also possible to process sheet-like products, such as cards, inter alia, by means of the process according to the invention and the apparatus according to the invention.

That which is claimed:

1. A process for stacking sheet-like products comprising the steps of arranging the products on a support one behind the other in a formation direction such that they overlap one another in an imbricated manner, wherein one of said products bears on a bottom edge of another of said products to cover the bottom edge thereof; orienting the imbricated products upon the support and transporting said products so that said bottom edges of said products extend across said support transverse to the formation direction; upending said products onto their bottom edge, wherein a predetermined number of products are arranged on the support in an imbricated formation in which a product arranged at one end of the formation lies with a flat side on the support and, in order to form a horizontal stack, the product arranged at the other end of the formation is brought to rest with its bottom edge oriented towards the support, against a stop, and the product lying with its flat side on the support is placed onto its bottom edge and is pushed in a direction towards the product resting against the stop.

2. The process as claimed in claim 1, further comprising the step of arranging said products on the support such that they overlap virtually fully in order to form a compacted imbricated formation which is then upended in order to form a stack.

3. An apparatus for stacking sheet-like products, comprising a support, a feed device for feeding products to the support such that the products are arranged on the support one behind the other in the longitudinal direction of said support and such that they overlap one another in an imbricated formation wherein a product bearing on an adjacent product covers a bottom edge of said adjacent product which is oriented towards the support and which is positioned so as to extend transverse to the longitudinal direction, said apparatus having means for upending the products onto each of said products' bottom edge, wherein the feed device feeds a predetermined number of products to the support wherein one of said products arranged at one end of the imbricated formation comes to lie with a flat side on the support, said apparatus further comprising a stop for acting on the bottom edge of a product arranged at the other end of the formation, said stop is configured to project beyond the support, said apparatus further comprising an upending element arranged in an initial position, beneath the product, lying with a flat side on the support, said upending element adapted to be moved into an upending position to upend said products onto their bottom edge, said upending element being adapted to be moved in the longitudinal direction of the support towards the stop.

4. The apparatus as claimed in claim 3, wherein the support comprises a supporting belt which is arranged in the longitudinal direction, said supporting belt being driven in a conveying direction for conveying the imbricated formation towards the stop with the bottom edge of the products bearing on the adjacent product at a leading end of the formation as seen in the conveying direction in front, wherein the stop is projected beyond the supporting belt and is arranged downstream in the conveying direction with respect to the upending element.

5. The apparatus as claimed in claim 3, wherein the upending element with a free end is mounted on a carrying element arranged beneath the support, said upending element being movable in a conveying direction such that it can be pivoted about an axis running at least substantially parallel to the support and at right angles with respect to the conveying direction, said upending element being pivotal from a horizontal position which it assumes in an initial position beneath the support and in which its free end is oriented away from the stop, into an upright position wherein it projects beyond the support.

6. The apparatus as claimed in claim 3, wherein the feed device comprises two conveyors arranged one behind the other, said conveyors adapted to be driven at different conveying speeds to arrange the products which have been fed by a first of said conveyors in a compacted imbricated formation upon transfer to a second of said conveyors, the products being fed to the support in said compacted imbricated formation.

7. The apparatus as claimed in claim 3 further comprising a stack transporter comprising a plurality of jaws adapted to be moved relative to one another and adapted to be rotated together about a common axis of rotation, a first of said jaws in a receiving position is arranged in a plane extending at least substantially at right angles with respect to the support, and a second of said jaws is adapted to be applied against a horizontal stack of said products on a side of said stack oriented towards the upending element, to clamp the stack fixedly between itself and the first of said jaws, to upend the stack by subsequent rotation of the jaws about the axis of rotation.

8. The apparatus as claimed in claim 7, wherein the jaws can be moved out of the receiving position and rotated and translated to a discharge position spaced apart from the support to discharge the stack in an upright position to a strapping or wrapping station.

9. The apparatus as claimed in claim 7, further comprising a delivery device for a wrapping element, said delivery device comprising an opening arranged adjacent said stop for applying an end section of the wrapping element to the products arranged at the end of the imbricated formation adjacent said stop, and the jaws being adapted to be moved out of a receiving position to a discharge position spaced apart from the support to discharge the stack in an upright position and wherein said stack is wrapped by means of said wrapping element.

10. The apparatus as claimed in claim 9, wherein, upon being moved from the receiving position into the discharge position, the jaws are rotated directionally together through at least 270°, wherein in the discharge position, the second of said jaws is arranged above the first of said jaws, and the jaws are moved in a translatory manner from one side of the opening to the other side.

* * * * *